United States Patent [19]

Taylor, Jr.

[11] 4,413,546

[45] Nov. 8, 1983

[54] DRUM MAGAZINE FOR CARBINES OR THE LIKE

[76] Inventor: William J. Taylor, Jr., 828 Sycamore Dr., Decatur, Ga. 30030

[21] Appl. No.: 217,236

[22] Filed: Dec. 17, 1980

[51] Int. Cl.[3] ..... F41C 25/10

[52] U.S. Cl. ..... 89/33 D

[58] Field of Search ..... 89/33 D, 34

[56] References Cited

U.S. PATENT DOCUMENTS

| | | | |
|---|---|---|---|
| 1,347,755 | 7/1920 | Payne | 89/33 D |
| 1,588,888 | 6/1926 | Haubroe | 89/33 D |
| 1,921,871 | 8/1933 | Gaidos | 89/33 D |
| 2,321,720 | 6/1943 | Whittaker | 89/33 D |

*Primary Examiner*—Stephen C. Bentley
*Attorney, Agent, or Firm*—Jones & Askew

[57] ABSTRACT

A drum magazine for feeding cartridges to an automatic or semi-automatic firearm such as a carbine or the like. A spiral cartridge receiving channel is formed within the drum, and a magazine extension joins the drum to feed cartridges into the magazine-receiving receptacle of the firearm. A number of rotor arms extend across the cartridge receiving receptacle, and are biased to feed the cartridges there along. The rotor arms can be manually indexed backwardly, allowing cartridges to be loaded one-by-one through the open end of the magazine extension.

5 Claims, 14 Drawing Figures

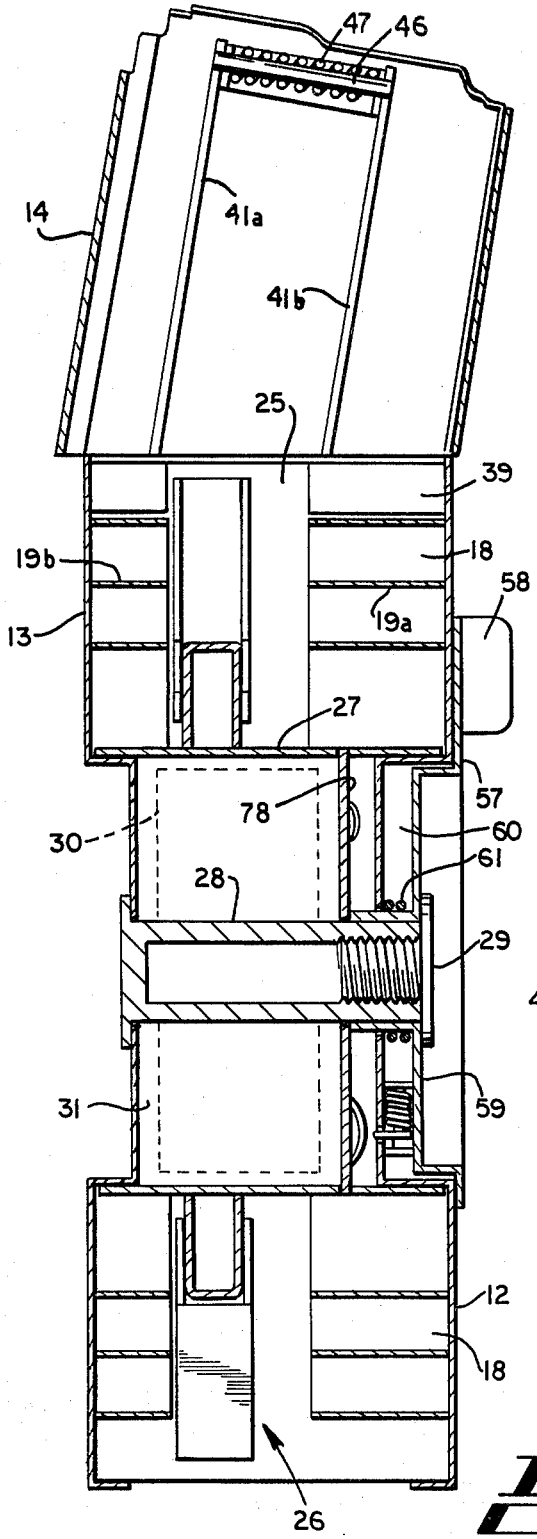
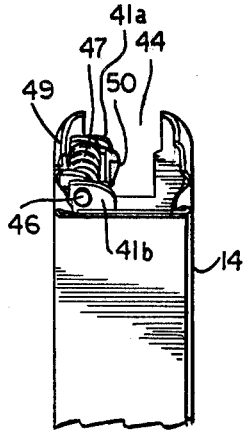
Fig. 5A
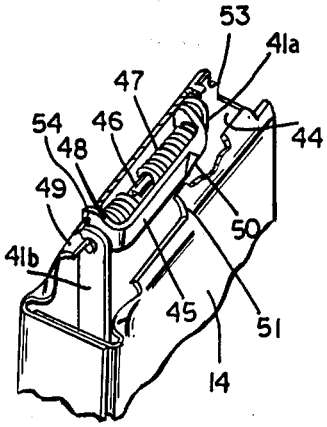
Fig. 5B
Fig. 4

DRUM MAGAZINE FOR CARBINES OR THE LIKE

BACKGROUND OF THE INVENTION

This invention relates in general to cartridge magazines for firearms, and in particular relates to drum magazines for column-feed firearms such as carbines or the like.

The increased cartridge-holding capacity of a drum magazine, compared to a linear or column-feed magazine, is known, and drum magazines have been used with various firearms. Drum magazines are generally designed for use with a particular firearm, which was itself designed specifically to accomodate a drum magazine. one such prior art drum magazine is shown in U.S. Pat. No. 2,131,412 to Ostman.

Such prior-art drum magazines generally cannot be used or easily adapted for use with carbines or other firearms designed to receive a linear magazine, inasmuch as such drum magazines have no provision for feeding cartridges along the existing magazine-receiving receptacle of the gun. In the case of firearms such as the M-16/AR-15, a drum magazine requires an extension several inches long, to fit within the magazine receptacle for feeding cartridges from the drum to the receiver of the firearm. This magazine extension should perpendicularly join the drum magazine to avoid upsetting the longitudinal center of gravity of the firearm. The requirement for a perpendicular magazine extension creates problems in feeding all cartridges from the drum to the firearm. The need for dependable feeding of cartridges through the cartridge path within the drum, as firing progresses, also presents problems.

Reloading the magazine is another problem associated with drum magazines. Although the magazine can be partially disassembled by removing a cover and exposing the cartridge receiving channel therein, this procedure has certain faults. For example, dirt or other foreign objects can become lodged in the opened magazine, possibly causing the magazine to jam or feed improperly. Moreover, removable covers or other components can easily become damaged or lost.

SUMMARY OF THE INVENTION

Stated in general terms, the drum magazine of the present invention provides a channel for receiving a number of cartridges, typically but not necessarily in a spiral or circular path. The magazine includes an extension configured to fit the magazine receiving receptacle of a particular firearm, and the extension defines a cartridge feeding channel communicating with the cartridge receiving channel of the drum. Contained within the drum are means for urging the cartridges in a forward or feeding direction along the cartridge receiving channel, and means for moving the cartridge urging means in a backward direction to facilitate loading cartridges into the drum.

Stated somewhat more specifically, the drum magazine includes a number of members extending across the cartridge receiving channel to divide that channel into a number of cartridge receiving spaces. Each such space is sufficient to hold a group of individual cartridges, and the members are biased to urge the cartridges along the channel for feeding into the magazine extension. The loading means includes an operating member operable from outside the drum magazine, and connected to index the cartridge space defining members backwardly a distance sufficient to receive one fresh cartridge.

Fresh cartridges may thus be loaded into the drum magazine one-by-one through the magazine extension, by indexing the members backwardly once for each cartridge being loaded. The magazine extension includes a member which permits cartridges to be loaded without interfering with cartridge feeding during firing.

Stated even more particularly, the drum magazine of the present invention includes a rotor having a number of radial arms extending across a spiral cartridge receiving channel. An external loading lever indexes the rotor a first distance for loading a cartridge into an available cartridge receiving space, and indexes the rotor a greater distance whenever a rotor arm would otherwise interfere with cartridge loading.

The nature of the present invention, as well as other objects and advantages thereof, will become more readily apparent from the following description of the disclosed preferred embodiment.

BRIEF DESCRIPTION OF DRAWINGS

FIG. 4 is a section view taken along line 4—4 of FIG. 3.

FIG. 5A is an enlarged fragmentary view showing details of the cartridge loading catch in the disclosed embodiment.

FIG. 5B is a fragmentary pictorial view showing the loading catch in detail.

DESCRIPTION OF PREFERRED EMBODIMENT

Figure 3:
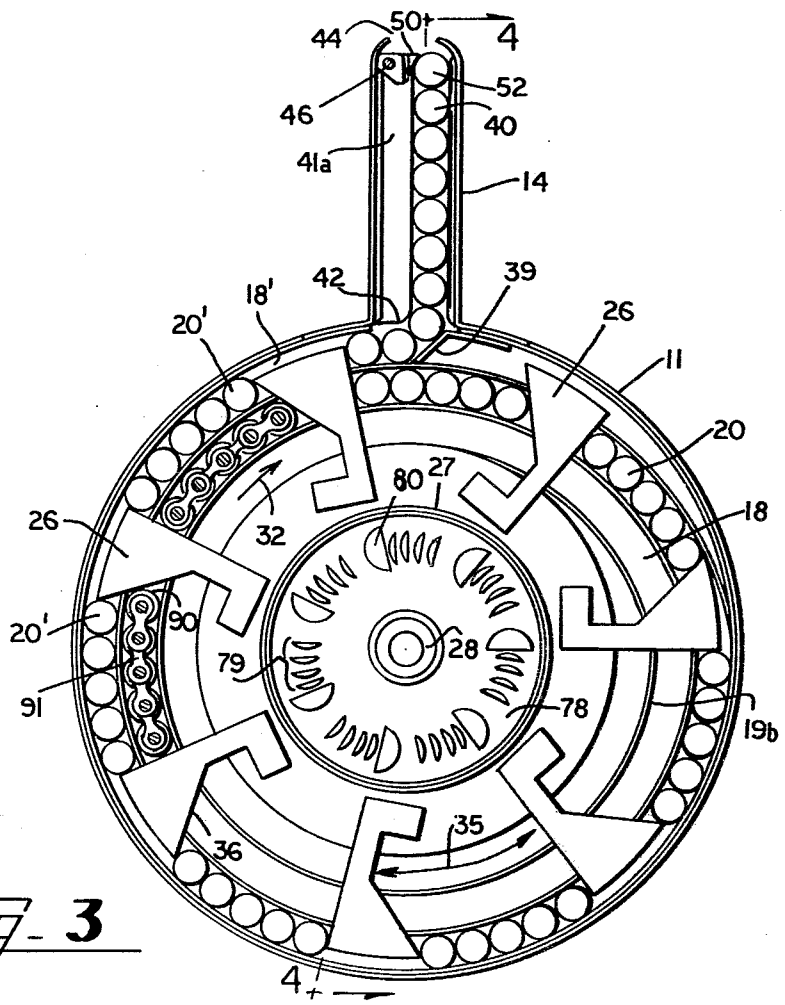
FIG. 3 is a front elevation view of the drum magazine shown in FIG. 1, with the front cover removed and with part of the magazine extension sectioned for illustration.
Figure 1:
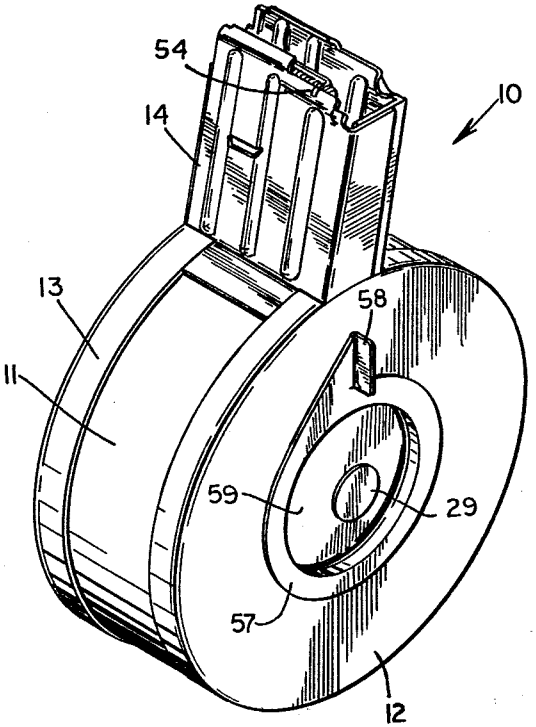
FIG. 1 is a pictorial view of a drum magazine according to a disclosed embodiment of the present invention.

Turning first to FIGS. 1–4, there is shown generally at 10 a drum magazine according to the disclosed embodiment of the present invention. The drum magazine 10 includes a cylindrical outer housing 11, and a front cover 12 and back cover 13 which fit over the open ends of the outer housing to enclose the drum magazine. The outer housing and covers can be stamped or otherwise formed from a suitable material such as sheet metal or the like.

A magazine extension 14 is attached to the outer housing 11 and extends radially outwardly from the outer housing. The magazine extension 14 will be inserted in the magazine receptacle of a firearm, and it will be understood that the external configuration of the magazine extension should be functionally the same as the corresponding configuration of the conventional magazine used in the particular type of firearm. The disclosed drum magazine 10 is designed to fit the M-16/AR-15 carbine, and so the length and external shape of the magazine extension 14 is configured accordingly. It should be understood, however, that drum magazines according to the present invention, can be designed for use with other firearms, for example, the M1 carbine, and in such case the dimensions of the magazine extension 14 and other elements of the drum magazine may be changed as necessary for the particular application.

Figure 2:
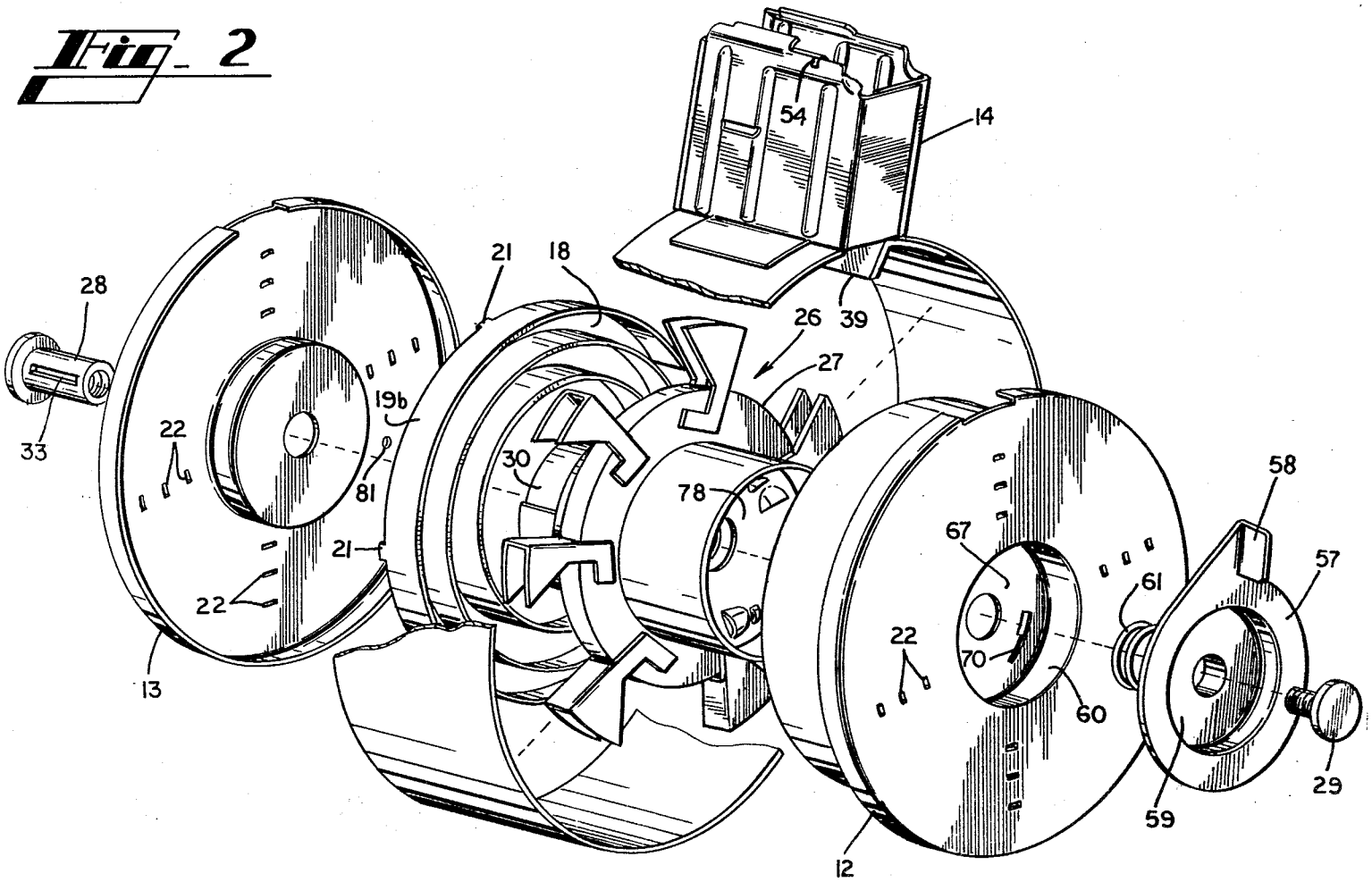
FIG. 2 is an exploded view of the drum magazine shown in FIG. 1.

The interior of the drum magazine 10 is best seen in FIGS. 2–4, and includes a spiral cartridge receiving channel 18 formed by a pair of aligned spiral skirts 19*a* and 19*b* connected to the insides of the front cover 12 and back cover 13, respectively. Each successive spiral of the spiral skirts 19*a* and 19*b* is radially spaced to define the spiral cartridge receiving channel 18 which, as best seen in FIG. 3, has a width selected to receive and support cartridges 20 of selected caliber. It will become apparent that the cartridges 20, disposed in side-by-side relation in the cartridge receiving channel 18, are fed to the magazine extension 14 by sliding along that channel, and so the channel width is slightly greater than the cartridge diameter to permit this sliding movement. A number of short projecting fingers 21 are formed on the cover-confronting edge of each spiral skirts 19*a* and 19*b*, and these fingers fit in corresponding slots 22 formed in the front cover 12 and back cover 13 for positive location of the spiral skirts within the outer housing 11.

The two spiral skirts 19*a* and 19*b* are separated from each other by the open space 25, FIG. 4, and a number of rotor arms 26 extend radially outwardly into that open space. The rotor arms 26 are attached to the rotor 27, which is supported within the outer housing 10 for rotation relative to the axle shaft 28 extending into the drum magazine from the back cover 13. The axle screw 29 fits into the hollow open end of the axle 28 from the front cover 12, and also functions to secure the front cover in assembly on the drum magazine.

A rotor spring 30 (FIG. 2) is disposed in the hollow interior space 31 between the rotor 27 and the axle 28. The rotor spring 30 may be a flat coil spring of the type commonly found in mechanical alarm clocks, and this spring biases the rotor 27 to rotate in the direction 32 shown in FIG. 3. The inner end of the spring 30 engages a slot 33 (FIG. 2) formed in the exterior of the axle 28, and the outer end of the rotor spring engages the rotor 27. Further details of a coil spring drive for a rotor within a drum magazine are shown in co-pending application Ser. No. 80,709 filed Oct. 1, 1979 by the same inventor, now U.S. Pat. No. 4,332,097.

The several rotor arms 26 extend radially through the open space 26 to lie across the cartridge receiving channel 18, and these rotor arms effectively divide the cartridge receiving channel into a number of separate cartridge receiving spaces 35 defined between two adjacent rotor arms. With a rotor having seven rotor arms 26 as shown in the disclosed embodiment, seven corresponding cartridge receiving spaces 35 are defined by the rotor arms, and it is seen from FIG. 3 that each cartridge receiving space includes several radially-adjacent segments of the spiral cartridge receiving channel 18.

Each cartridge receiving space 35 is sufficient to accommodate several individual cartridges 20 in side-by-side relation along the channel 18, and one side 36 of each rotor arm 26 is raked forwardly to maintain the desired cartridge-receiving capacity of the radially-adjacent cartridge receiving spaces between two adjacent rotor arms, thereby compensating for the different circumferential lengths of the radially-adjacent spaces. It will be seen that the cartridge receiving spaces 35 move in unison along the cartridge receiving channel 18 as the rotor 27 rotates in either direction to move the rotor arms 26 through the open space 25 between the spiral skirts 19*a* and 19*b* which define the cartridge receiving channel.

The open interior of the magazine extension 14 communicates with the outermost spiral 18' of the cartridge receiving channel 18, as best seen in FIG. 3. A cartridge deflecting ramp 39 extends downwardly into the outermost spiral 18' below the junction with the magazine extension 14, and the ramp routes the cartridges 20 through the right-angle turn from the outer spiral 18' to the magazine extension 14.

The magazine extension 14 is configured to feed rounds in a single column 40, instead of the staggered-column feed typically found in a conventional M-16/AR-15 carbine magazine. Because the exterior of the magazine extension 14 must be configured to resemble a conventional, i.e., staggered-column magazine, spacers 41*a* and 41*b* extend vertically within the magazine extension to reduce the effective interior to feed rounds in the single column 40. The lower end 42 of each spacer 41*a* and 41*b* is rounded as shown in FIG. 3, and is spaced outwardly from the confronting surface of the ramp 39 approximately the width of the cartridge receiving channel 18, to provide a smooth transition for the cartridges moving between the spiral channel and the straight column 40 within the magazine extension 14.

The uppermost end 44 of the magazine extension 14 is open in the conventional manner, so that rounds are fed from the magazine to the gun when fired. Disposed just below the open end 44 is the loading catch 45, pivotably supported on the loading catch pin 46 extending between the two vertical-extending spacers 41*a*, 41*b* within the magazine extension. The spiral spring 47 around the pin 46 maintains the loading catch 45 in an upright position as shown in FIGS. 5A and 5B, and permits the loading catch to be depressed downwardly when loading a round into the drum magazine in the manner described below.

The ridge 48 at one end of the loading catch 45 engages the notch 54 formed in the inwardly-turned lip 49 of the magazine extension 44 to define the normal spring-biased position of the loading catch. The loading catch 45 includes a ramp-like protrusion 50 facing the spaced-apart lip 51 on the opposite side of the magazine extension, and the protrusion 50 urges the uppermost round 52 (FIG. 3) in the column 40 to engage the lip 51, thereby preventing the round from falling out of the uppermost end 44 of the magazine extension. The uppermost round 52 is thus able to leave the magazine extension only through the front 53 thereof, while feeding in a gun in the conventional manner.

Because the drum magazine 10 is preferably loaded through the uppermost end 44 of the magazine extension 14, one round at a time, it is necessary to move the rotor 27 in a backward direction, against the force of the rotor spring 30 urging the rotor in the forward direction 32, to facilitate loading. Even if it were possible to force enough new rounds into the magazine extension 14 to enter the outermost spiral 18' and fill the first cartridge receiving space 35 encountered within the drum, thus forcing the rotor back by the displacement of newly-loaded rounds, a rotor arm 26 would eventually move into position blocking the lower end of the column 40 within the magazine extension. Forced loading through the magazine extension would be impossible at that point.

Backward movement of the rotor 27 is accomplished by the loading lever 57, having a finger-engaging extension 58 extending forwardly from the front cover 12 of the drum magazine. The main body 59 of the loading lever 57 nests within the dished well 60 formed in the front cover 12, and is retained in place by the axle screw 29. The loading lever 57 is pivotable about the axle screw, and is normally urged in a clockwise position (as viewed in FIG. 2) by the loading lever spring 61 shown in FIGS. 2 and 4.

Carried by the loading lever 57 on the underside of the main body 59 is the pawl housing 63. One end of the elongated and arcuately-shaped pawl 64 is retained in the pawl housing 63 on the pin 65, and the pawl spring 66 is wound on the pin 65 so as to engage the urge the pawl downwardly toward the pawl plate 67.

Figure 8:
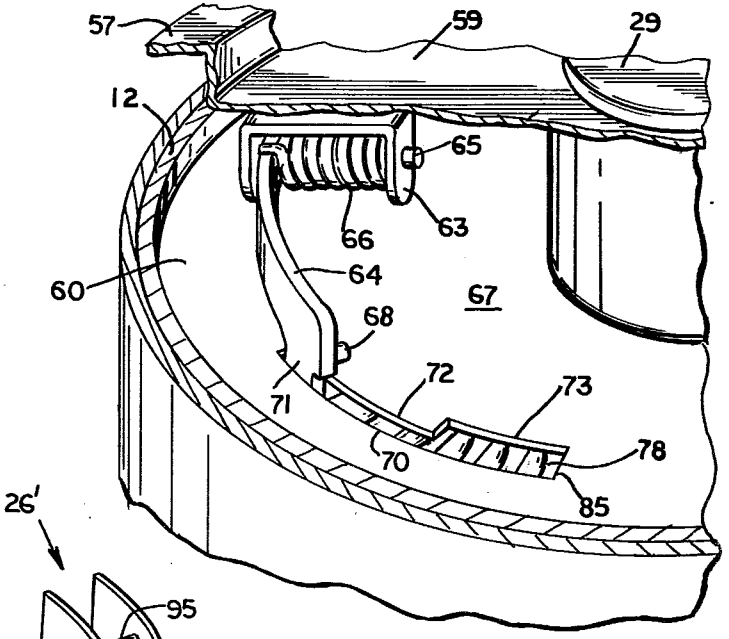
FIG. 8 is an enlarged fragmentary pictorial view of the indexing mechanism.
Figure 7:
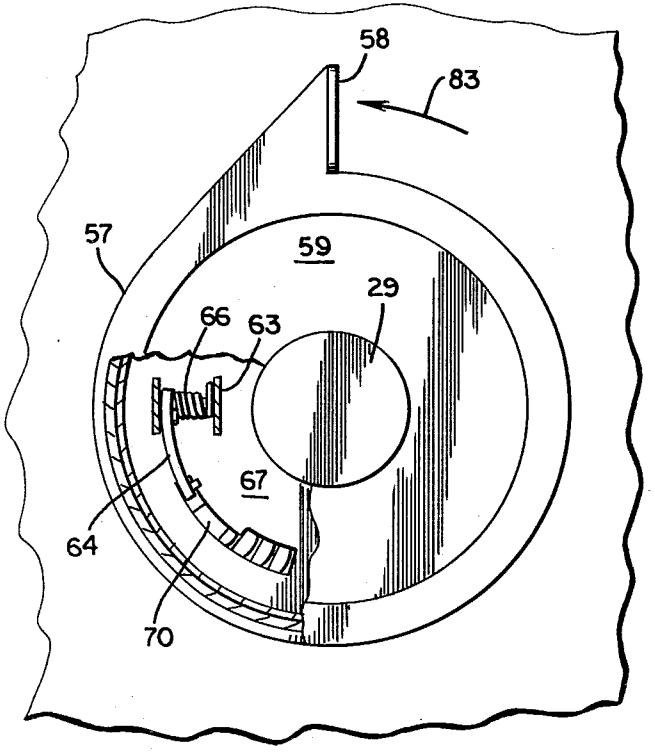
FIG. 7 is a fragmentary view of the drum magazine front cover, with the loading lever shown partially broken away to reveal details of the indexing mechanism.

An arcuate slot 70 is formed in the pawl plate 67, and as best seen in FIGS. 7 and 8 the forward end 71 of the pawl 64 is urged by the pawl spring 66 to extend downwardly into the slot. The slot 70 is curved to be radial relative to the axle 28 about which the loading lever 57 pivots, and the arcuate shape of the pawl 64 is likewise radial to permit reciprocal rotary movement along the slot 70.

The slot 70 has as relatively narrow first portion 72, and a relatively wider second portion 73 extending beyond the narrow portion. A pawl pin 68 is attached to the pawl 64 near the forward end 71, and as best seen in FIG. 8, the pawl pin contacts the pawl plate 67 when the forward end of the pawl is on the narrow portion 72 of the slot 70. As becomes apparent, the pawl pin 68 drops through the wider portion 73 of the slot when the forward end 71 of the pawl 70 is over the wider portion, allowing the forward end of the pawl to move further below the pawl plate 67 for a reason discussed below.

Located beneath the pawl plate 67 is the rotor indexing plate 78 (FIGS. 3, 4, and 6A–6E), which forms part of the rotor 27. A number of pawl-engaging small detents 79 are formed in the indexing plate 78, located in clusters along a circumferential path around the indexing plate as best seen in FIG. 3. A relatively large pawl-engaging detent 80 is formed on the indexing plate 80 between each cluster of small detents 79. Both the large detents and the small detents may take the form of dimples stamped or otherwise formed in the indexing plate 78, and as best seen in FIGS. 6A–6E, the large detents 80 extend further toward the pawl plate 67 than do the small detents 79.

Referring again to FIG. 3, it may be seen that each small detent 79 corresponds in number and in angular position to a cartridge location within each cartridge receiving space 35, with the exception of the forwardmost cartridge 20' in each space 35. Moreover, each large detent 80 likewise corresponds to a forwardmost cartridge 20 and the rotor arm 26 abutting that forwardmost cartridge.

Figure 6A:
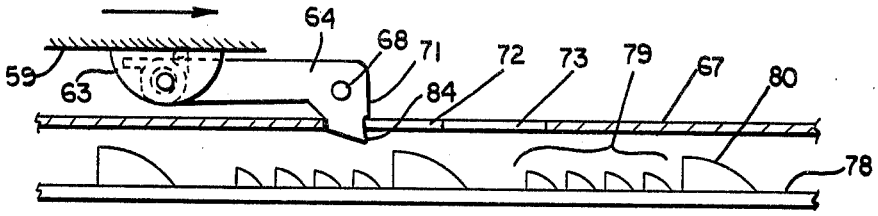
FIGS. 6A–6E are fragmentary vertical section views, enlarged and depicted in linear movement for illustrative purposes, showing the rotor indexing mechanism.
Figure 6B:
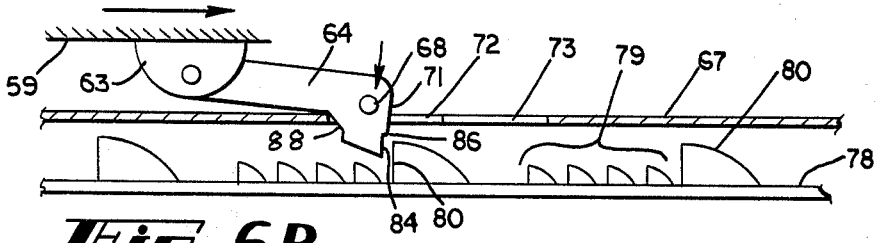
Figure 6C:
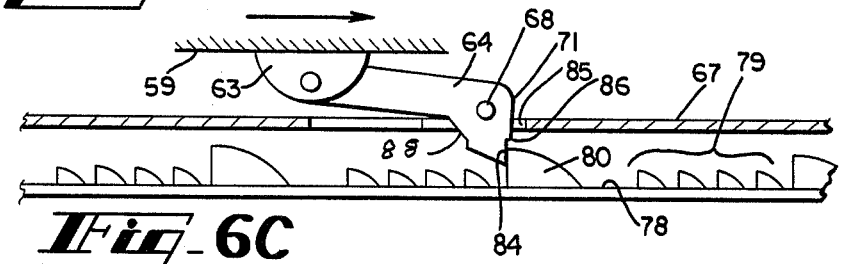

Loading the drum magazine 10 is accomplished in the following manner. Before loading a cartridge, the loading lever 57 is manually rotated counter-clockwise as shown at 83 in FIG. 7. The loading lever 45 rotates against the force of the loading lever spring 61, causing the pawl 64 to move in the pawl opening 70 and engage either a small detent 79 or a large detent 80. If the rotor indexing plate 78 is positioned so that one of the large detents 80 is beneath the relatively narrow slot portion 72 as illustrated in FIG. 6A, the detent engaging lower end 84 of the pawl 64 engages the large detent as shown in FIG. 6B and rotates the indexing plate 78 until the forward end 71 of the pawl contacts the forward end 85 of the slot larger portion 73, a condition being approached in FIG. 6C. The ridge 86 formed on the front end 71 of the pawl 64, upwardly from the lower end 84, engages the large detent 80 to prevent the pawl 64 from moving downwardly while the pawl traverses the wider portion 73 of the slot.

Because each large detent 80 is angularly aligned with a rotor arm 26, a large detent is engaged by the pawl 64 whenever a corresponding rotor arm is positioned immediately below the cartridge feeding column 40 in the magazine extension 14. When the indexing plate 78 and the rotor are rotated counter-clockwise by engagement of a large detent 80, the rotor is indexed sufficiently to move the rotor arm past the magazine extension far enough to allow one round to feed downwardly into the outermost spiral 18' from the magazine extension 14. The space thus created in the magazine extension 14 provides room for the insertion of a fresh round through the uppermost end 44 of the magazine extension, moving past the loading catch 45 as previously described.

The loading lever 57 is now released, allowing the loading lever spring 61 to return the loading lever to its initial position withdrawing the pawl 64 to the position shown in FIG. 6A. The underside of the pawl 64 has an angled surface 88 facing the back end 87 of the slot 70, so as to raise the pawl 64 upwardly to the resting position shown in FIG. 6A, out of engagement with a detent.

Figure 6D:
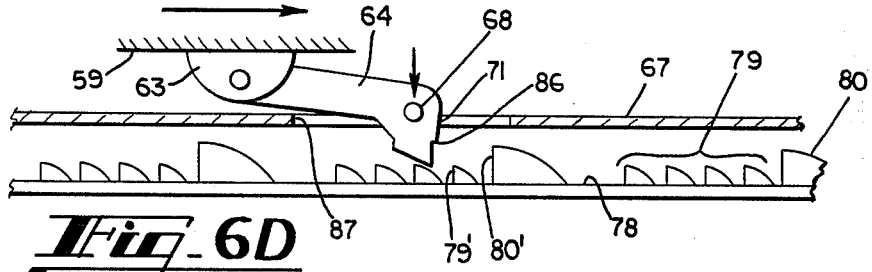
Figure 6E:
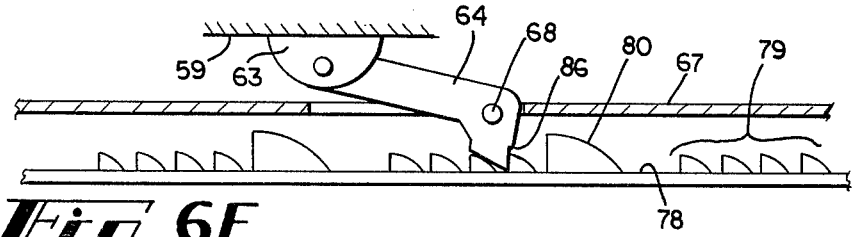

The next counter-clockwise movement of the loading lever 57 causes the pawl 64 to travel along the narrow portion 72 of the slot without contacting a large detent, because the large detent was indexed by the preceeding forward stroke of the pawl. The pawl 64 thus continues to move forwardly until the pawl pin 68 enters the wider slot portion 73, allowing the pawl spring 66 to move the pawl downwardly to engage the small detent 79' next following the large detent 80' (FIG. 6D). Continued forward movement of the pawl 64 thus indexes the rotor to a lesser extent, allowing one additional cartridge to enter the outermost spiral 18 from the magazine extension 14. This movement provides room for loading another fresh round into the outermost end 44 of the magazine extension.

The foregoing loading cycle is repeated as often as desired, until the entire cartridge receiving channel 20 is filled. The small detents 79 will be engaged four successive times before another large detent 80 is again contacted. A suitable opening 81 in one of the magazine covers can be provided, if desired, for visual indication of alignment with a predetermined rotor element when the magazine is fully-loaded.

When rounds are fired from the loaded drum magazine, the rotor spring 30 indexes the rotor forwardly to feed successive cartridges up the column 40 in the magazine extension. As the last cartridge in each cartridge receiving space 35 moves up the ramp 39 to enter the column 40, the rotor spring automatically indexes the rotor a greater amount to move the rotor arm 26 past the ramp, thereby placing the first cartridge 20' of the next cartridge receiving space in position in enter the magazine extension. In order to feed the final rounds remaining in the cartridge receiving channel 20, one or more cartridge receiving spaces 35 following the final live cartridge is filled with groups of dummy rounds 90, seen in detail in FIG. 9. Each group of dummy rounds consists of dummy rounds 90 in number corresponding to the number of cartridges 20 otherwise contained in a cartridge receiving space 35 between two rotor arms 26. The drummy rounds 90 need only approximate the exterior shape of the live cartridges 20 for which the drum magazine is designed, and each dummy round in a group is flexibly interconnected to its neighbor by links 91, which may be interconnected in the manner of a bicycle chain linkage. The flexible interconnection of dummy rounds in each group allows these rounds to move past the ramp 39 and enter the verticle column 40 in the magazine extension, as cartridge feeding progresses.

Figure 9:
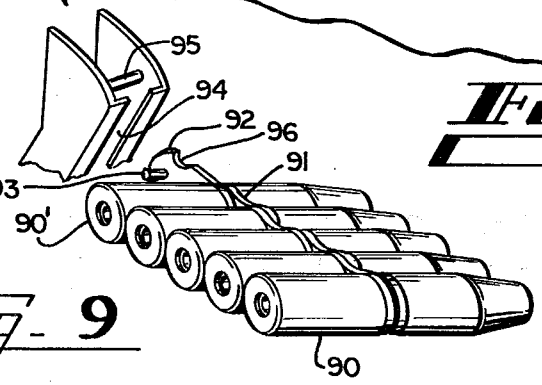
FIG. 9 is a pictorial view showing a dummy round assembly forming part of the disclosed embodiment.

The disclosed drum magazine 10 requires two groups of linked dummy rounds 90 in order to feed the final live round to the top of the magazine extension 14. Other embodiments of the present drum magazine may require a shorter magazine extension, and only a single linked group of dummy rounds may be necessary. It may be desirable, particularly in applications where only a single group of linked dummy rounds is required, to link the last dummy round 90' to the rotor arm 26' (FIG. 9) pushing that last dummy round, in order to prevent the rotor spring from completely unwinding if the rotor arm is allowed to move past the remaining dummy round. This is accomplished by providing an extension link 92 extending backwardly beyond the last dummy round 90', and equipped with a pin 93 extending outwardly from both sides of the hook. The corresponding rotor arm 26' is modified as shown in FIG. 9 to have a slotted wall 94 through which the hook 92 extends, and a rotor arm pin 95 bridging the spaced-apart walls of the rotor arm a short distance behind the slotted wall. The hook 92 thus extends through the slotted wall 94, and the pin 93 extends behind the slotted wall to retain the hook in place. The pin-engaging recess 96 formed in the hook 92 engages the pin 95 as the last dummy round 90' moves over the ramp 39, thereby preventing the rotor arm 26' from further movement.

It will be apparent that the foregoing is but one embodiment of the present invention, and that numerous changes and modifications may be made therein without departing from the spirit and scope of the invention as defined in the following claims.

I claim:

1. Drum magazine apparatus for successively feeding a plurality of cartridges to a firearm, comprising:

means defining a housing;

means within said housing to define a channel for receiving a plurality of cartridges in serial relation relative to a feeding end of said channel;

extension means associated with said housing and defining a cartridge feeding channel in communication with said feeding end of said cartridge receiving channel;

means within said housing operative to urge said plural cartridges in a forward direction along said cartridge receiving channel toward said cartridge feeding channel;

loading means selectably operative from outside said housing to move said cartridge urging means in a backward direction sufficiently to admit one cartridge at said feeding end, so as to permit loading a cartridge into the open end of said cartridge receiving channel through said cartridge feeding channel;

said cartridge receiving path being an arcuate path within said housing;

said cartridge urging means comprising a rotor having a plurality of arms extending outwardly from the rotor in angularly spaced apart relation and disposed across said cartridge receiving channel, so that said arms define a number of cartridge receiving spaces along the cartridge receiving channel;

each said cartridge receiving space being sufficient to accommodate several individual cartridges in side-by-side relation, and each cartridge space being separated from an adjacent cartridge space by an arm;

means operative to urge said rotor in said forward direction along the cartridge receiving channel, so that said cartridge spaces and the individual cartridges received therein are moved along the cartridge receiving channel toward said feeding end as cartridges are fed from said extension means;

a plurality of detents associated with said rotor;

an operating means operable from outside said housing to engage a detent and move said rotor back sufficiently to receive a cartridge;

said detents comprising plural groups of first detents, each such detent group corresponding to one of said cartridge receiving spaces defined between two adjacent rotor arms;

each said group of first detents having a plurality of first detents corresponding in number to the number, minus one, of cartridges accommodated by the corresponding cartridge receiving space and being operative to move said rotor back a first distance when engaged by said operating means;

each group of first detents being separated from an adjacent group of detents by a second detent, each of said second detents corresponding to one of said rotor arms; and said second detents operative to move said rotor back a second distance greater than said first distance whenever one of said rotor arms is aligned with said feeding end of said cartridge receiving channel.

2. Apparatus as in claim 1, wherein:

said operating means comprises a detent engaging member selectably movable along a first path to engage a second detent and movable along a second path to engage a first detent if no second detent was engaged while moving along the first path.

3. Apparatus as in claim 2, wherein:

said detent engaging member is operative to engage only a second detent while moving along said first path, and is operative to engage the nearest first detent encountered on said second path after traversing the first path without engaging a detent.

4. Drum magazine apparatus for successively feeding a plurality of cartridges to a firearm, comprising:

means defining a housing;

means within said housing to define a channel for receiving a plurality of cartridges in serial relation relative to a feeding end of said channel;

extension means associated with said housing and defining a cartridge feeding channel in communication with said feeding end of said cartridge receiving channel;

means within said housing operative to urge said plural cartridges in a forward direction along said cartridge receiving channel toward said cartridge feeding channel;

loading means selectably operative from outside said housing to move said cartridge urging means in a backward direction sufficiently to admit one cartridge at said feeding end, so as to permit loading a cartridge into the open end of said cartridge receiving channel through said cartridge feeding channel;

said cartridge urging means comprising a plurality of arms disposed in spaced apart relation across said cartridge receiving channel to engage selected cartridges in said cartridge receiving channel so that said arms define a number of cartridge spaces, each such cartridge space sufficient to receive a group of individual cartridges in side-by-side relation, and each cartridge space being separated from an adjacent cartridge space by an arm;

means operative to urge said arms in unison in said forward direction along the cartridge receiving channel, so that said cartridge spaces and the groups of cartridges received therein are urged to move along said cartridge receiving channel as cartridges move from the receiving channel to said cartridge feeding channel;

said loading means being operative to move said arms in unison back a first distance whenever one of said cartridge receiving spaces is aligned with said feeding end of the cartridge receiving channel, and is operative to move said arms back a second distance greater than said first distance whenever one of said arms is aligned with the feeding end of the cartridge receiving channel;

said cartridge urging means comprising a rotor having said plurality of arms extending outwardly from the rotor in angularly spaced apart relation and disposed across said cartridge receiving channel, so that said arms define said cartridge receiving spaces along the cartridge receiving channel;

each said cartridge receiving space being sufficient to accommodate several individual cartridges in side-by-side relation, and each cartridge space being separated from an adjacent cartridge space by an arm;

said loading means being operative to move said rotor back said first distance whenever a cartridge receiving space is aligned with said feeding end of the cartridge receiving channel, and to move said rotor back said second distance whenever one of said rotor arms is aligned with the feeding end of the cartridge receiving channel;

said loading means comprising plural groups of first detents associated with said rotor, each such detent group corresponding to one of said cartridge receiving spaces defined between two adjacent rotor arms;

each said group of first detents having a plurality of first detents corresponding in number to the number, minus one, of cartridges accommodated by the corresponding cartridge receiving space and being operative to move said rotor back a first distance when engaged by said operating means;

each group of first detents being separated from an adjacent group of detents by a second detent, each of said second detents corresponding to one of said rotor arms;

said second detents operative to move said rotor back a second distance greater than said first distance whenever one of said rotor arms is aligned with said feeding end of said cartridge receiving channel; and an operating means operable from outside said housing to engage a detent and move said rotor back sufficiently to receive a cartridge.

5. Apparatus as in claim 4, wherein:

said operating means comprises a detent engaging member selectably movable along a first path to engage a second detent and movable along a second path to engage a first detent if no second detent was engaged while moving along the first path.

* * * * *